US007684723B2

(12) United States Patent
Kikuchi

(10) Patent No.: US 7,684,723 B2
(45) Date of Patent: Mar. 23, 2010

(54) IMAGE FORMING APPARATUS HAVING STORAGE BATTERY

(75) Inventor: Nobuhiro Kikuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 685 days.

(21) Appl. No.: 11/608,366

(22) Filed: Dec. 8, 2006

(65) Prior Publication Data

US 2007/0140724 A1 Jun. 21, 2007

(30) Foreign Application Priority Data

Dec. 20, 2005 (JP) ..... 2005-366453

(51) Int. Cl.
*G03G 15/00* (2006.01)

(52) U.S. Cl. ..... 399/88; 399/82

(58) Field of Classification Search ..... 399/82, 399/88

See application file for complete search history.

(56) References Cited

U.S. PATENT DOCUMENTS 5,282,054 A * 1/1994 Oana et al. ..... 358/406
5,700,994 A 12/1997 Gheer et al.
5,914,538 A * 6/1999 Kurosawa et al. ..... 307/18
2002/0101622 A1* 8/2002 Yamaguchi ..... 358/423

FOREIGN PATENT DOCUMENTS

JP 10-010913 A 1/1998

* cited by examiner

*Primary Examiner*—David M Gray
*Assistant Examiner*—Ryan D Walsh
(74) *Attorney, Agent, or Firm*—Canon U.S.A., Inc. I.P. Division

(57) ABSTRACT

An image forming apparatus includes an image forming unit; a fixing device; a main power circuit configured to supply electric power; an auxiliary power circuit configured to store and supply the electric power; a switching device configured to switch between a charge and discharge mode for the auxiliary power circuit; and a control device configured to, when the image is formed by a facsimile function, control the switching device so as to operate the auxiliary power circuit not in the discharge mode so that the electric power of the main power circuit is supplied to the fixing device, and when the image is formed on the basis of other functions, control the switching device so as to operate the auxiliary power circuit in the discharge mode so electric power of the main power circuit and that of the auxiliary power circuit are supplied to the fixing device.

5 Claims, 8 Drawing Sheets

IMAGE FORMING APPARATUS HAVING STORAGE BATTERY

BACKGROUND OF THE INVENTION

1. Field of the Invention

The present invention relates to an image forming apparatus having a storage battery.

2. Description of the Related Art

Image forming apparatuses, such as copiers, typically employ an electrophotographic method in view of high speed performance, image quality, cost, and the like, in image formation. The electrophotographic method is a method for forming a toner image on a recording medium, and fixing the formed toner image on the recording medium with heat and pressure. The heat roller method is most widely used as a fixing method for safety purposes. The heat roller method includes a mutual pressure portion, called a nip portion, at which a heating roller that applies heat by way of a heating member such as a halogen heater, is pressed to a pressing roller disposed opposite to the heating roller. The recording medium to which the toner image is transferred passes through the nip portion, and is heated and pressed, so that the toner is fixed on the recording medium.

Recently, with regard to image forming apparatuses, environmental issues have been given more importance. As a result, image forming apparatuses, such as copiers and printers, have been designed to work on energy saving. The key point of energy saving for such an image forming apparatus is power consumption of a fixing device that fixes toner on the recording medium.

To reduce the power consumption of a fixing device in a standby state where image formation is not performed, there is widely chosen a method that the temperature of the heating roller is held at a predetermined temperature that is slightly lower than a fixing temperature in the standby state, and the temperature of the heating roller is raised to the fixing temperature immediately in response to an image formation instruction. In this case, a certain amount of electric power needs to be supplied even when the fixing device is not in use, and accordingly, the image forming apparatus consumes wasteful energy. In particular, the energy consumption in the standby state is as high as about 70% to 80% of the energy consumption of components of the image forming apparatus.

Therefore, it is desirable that the energy consumption is reduced in the standby state, so that the electric power is further saved. In addition, it is desirable that no energy is supplied when the image forming apparatus is not in use. However, since the heating roller of the fixing device mainly employs a metal roller made of iron, aluminum, or the like, which has a large heat capacity, if no energy is supplied in the standby state, the fixing device needs a heating time as long as several minutes to several tens of minutes to be raised to the effective temperature (around 180° C.). This waiting time may deteriorate usability of a user, and accordingly, a heating method which has power consumption as small as possible and has a rising time from the standby state as short as possible is desired.

To reduce the temperature rising time of the heating roller, input energy per unit time, i.e., the necessary rated power can be increased. Namely, even though the temperature of the heating roller is attempted to be raised for a short period of time, the maximum input energy is determined by a power source capacity. However, the available electric power source capacity is limited in most conventional power sources, and special work is necessary for power source equipment to obtain larger electric power. Thus, it is not a common solution.

To address the problem, there has been considered an image forming apparatus that has a secondary battery which may store electric power, as an auxiliary power source. In such an image forming apparatus, the secondary battery is charged in the standby state of the fixing device, and when the fixing device is activated, electric power is supplied to the fixing device from a main power source device, and also from the secondary battery or a primary battery to reduce a rising time of the fixing device (for instance, see Japanese Patent Laid-Open No. 10-010913).

The secondary battery may be typically a lead storage battery, a nickel cadmium battery, or a nickel hydride battery. Such a secondary battery may be deteriorated in a charging capacity due to repetition of charging and discharging. In addition, the secondary battery has characteristics in that the life thereof becomes shorter as larger electric current is discharged.

When the number of rising of the temperature of the fixing device cycles increases, the repetition of the charging and discharging increases. Accordingly, the secondary battery may be degraded fast, and needs to be replaced frequently. The replacement of the secondary battery is troublesome and increases the cost of batteries to be replaced.

SUMMARY OF THE INVENTION

The present invention provides an image forming apparatus that overcomes the above-described problems.

Alternatively, the present invention provides an image forming apparatus that, when a storage battery device such as a secondary battery is used, allows the life of the storage battery device to be increased.

According to an aspect of the present invention, an image forming apparatus is provided having a first function for forming an image received by facsimile, and a second function for forming an image other than the image received by the facsimile. The apparatus includes an image forming unit configured to form a toner image on a sheet; a fixing device configured to fix the toner image to the sheet; a main power circuit configured to supply electric power for operating the image forming apparatus; an auxiliary power circuit configured to store the electric power and supply the stored electric power for operating the image forming apparatus; a switching device configured to switch between a charge mode for charging the auxiliary power circuit and a discharge mode for discharging the stored electric power in the auxiliary power circuit; and a control device configured to, when the image is formed on the basis of the first function, control the switching device so as to operate the auxiliary power circuit not in the discharge mode so that the electric power of the main power circuit is supplied to the fixing device, and when the image is formed on the basis of the second function, control the switching device so as to operate the auxiliary power circuit in the discharge mode so that the electric power of the main power circuit and that of the auxiliary power circuit are supplied to the fixing device.

According to another aspect of the present invention, an image forming apparatus is provided having a first function for forming an image received by facsimile, and a second function for forming an image other than the image received by the facsimile. The apparatus includes a main power circuit configured to supply electric power for operating the image forming apparatus; an auxiliary power circuit configured to store the electric power and supply the stored electric power for operating the image forming apparatus; a switching device configured to switch between a charge mode for charging the auxiliary power circuit and a discharge mode for discharging the stored electric power in the auxiliary power circuit; and a control device configured to, when the image is formed on the basis of the first function, operate the auxiliary power circuit in the charge mode to operate the image forming apparatus with the electric power of the main power circuit, and when the image is formed on the basis of the second function, operate the auxiliary power circuit in the discharge mode to operate the image forming apparatus with the electric power of the main power circuit and that of the auxiliary power circuit.

Furthermore, according to yet another aspect of the present invention, the image forming apparatus may further include a time range setting device configured to set a time range for operating the auxiliary power circuit in the charge mode when an image formation start instruction is input, regardless of whether the image is formed on the basis of the first function or the second function.

Moreover, according to still another aspect of the present invention, the image forming apparatus may further include a function setting device configured to set whether a function for operating the auxiliary power circuit in the charge mode is made effective or not, when the image is formed on the basis of the first function.

Additionally, according to another aspect of the present invention, an image forming apparatus is provided having a first function for forming an image received by facsimile, and a second function for forming an image other than the image received by the facsimile. The apparatus includes a main power circuit configured to supply electric power for operating the image forming apparatus; an auxiliary power circuit configured to store the electric power and supply the stored electric power for operating the image forming apparatus; a switching device configured to switch between a charge mode for charging the auxiliary power circuit and a discharge mode for discharging the stored electric power in the auxiliary power circuit; and a control device configured to shift the image forming apparatus to a power save mode if the image forming apparatus does not form the image for a predetermined time period. When the power save mode is deactivated for forming the image on the basis of the first function, the control device operates the auxiliary power circuit in the charge mode to operate the image forming apparatus with the electric power of the main power circuit, and when the power save mode is deactivated for forming the image on the basis of the second function, the control device operates the auxiliary power circuit in the discharge mode to operate the image forming apparatus with the electric power of the main power circuit and that of the auxiliary power circuit.

Furthermore, according to yet another aspect of the present invention, an image forming apparatus is provided which includes a main power circuit configured to supply electric power for operating the image forming apparatus; an auxiliary power circuit configured to store the electric power and supply the stored electric power for operating the image forming apparatus; a switching device configured to switch between a charge mode for charging the auxiliary power circuit and a discharge mode for discharging the stored electric power in the auxiliary power circuit; a control device configured to shift the image forming apparatus to a power save mode if the image forming apparatus does not form the image for a predetermined time period; and an illuminance detecting device configured to detect the illuminance of the installation place of the image forming apparatus. When the power save mode is deactivated, if the illuminance detected by the illuminance detecting device is a predetermined value or less, the control device operates the auxiliary power circuit in the charge mode to operate the image forming apparatus with the electric power of the main power circuit, and if the illuminance detected by the illuminance detecting device is more than the predetermined value, the control device operates the auxiliary power circuit in the discharge mode to operate the image forming apparatus with the electric power of the main power circuit and that of the auxiliary power circuit.

And still further, according to another aspect of the present invention, the image forming apparatus may further include a time range setting device configured to set a time range for operating the auxiliary power circuit in the charge mode when an image formation start instruction is input, regardless of the detected illuminance.

Also, according to another aspect of the present invention, the image forming apparatus may further include a function setting device configured to set whether a function for operating the auxiliary power circuit in the charge mode is made effective or not, if the detected illuminance is the predetermined value or less.

Additionally, according to yet another aspect of the present invention, an image forming apparatus is provided which includes a main power circuit configured to supply electric power for operating the image forming apparatus; an auxiliary power circuit configured to store the electric power and supply the stored electric power for operating the image forming apparatus; a switching device configured to switch between a charge mode for charging the auxiliary power circuit and a discharge mode for discharging the stored electric power in the auxiliary power circuit; and a control device configured to shift the image forming apparatus to a power save mode if the image forming apparatus does not form the image for a predetermined time period; and a human detecting device configured to detect whether or not a person is present around the image forming device. When the power save mode is deactivated, if no person is detected by the human detecting device, the control device operates the auxiliary power circuit in the charge mode to operate the image forming apparatus with the electric power of the main power circuit, and if a person is detected by the human detecting device, the control device operates the auxiliary power circuit in the discharge mode to operate the image forming apparatus with the electric power of the main power circuit and that of the auxiliary power circuit.

Moreover, according to yet another aspect of the present invention, the image forming apparatus may further include a time range setting device configured to set a time range for operating the auxiliary power circuit in the charge mode when an image formation start instruction is input, regardless of the detection result of the human detecting device.

And, according to another aspect of the present invention, the image forming apparatus may further include a function setting device configured to set whether a function for operating the auxiliary power circuit in the charge mode is made effective or not, if no person is detected by the human detecting device.

Further features and aspects of the present invention will become apparent from the following description of exemplary embodiments with reference to the attached drawings.

DESCRIPTION OF THE EMBODIMENTS

Numerous embodiments, features and aspects of the present invention will now herein be described below with reference to the attached drawings.

First Exemplary Embodiment

Figure 1:
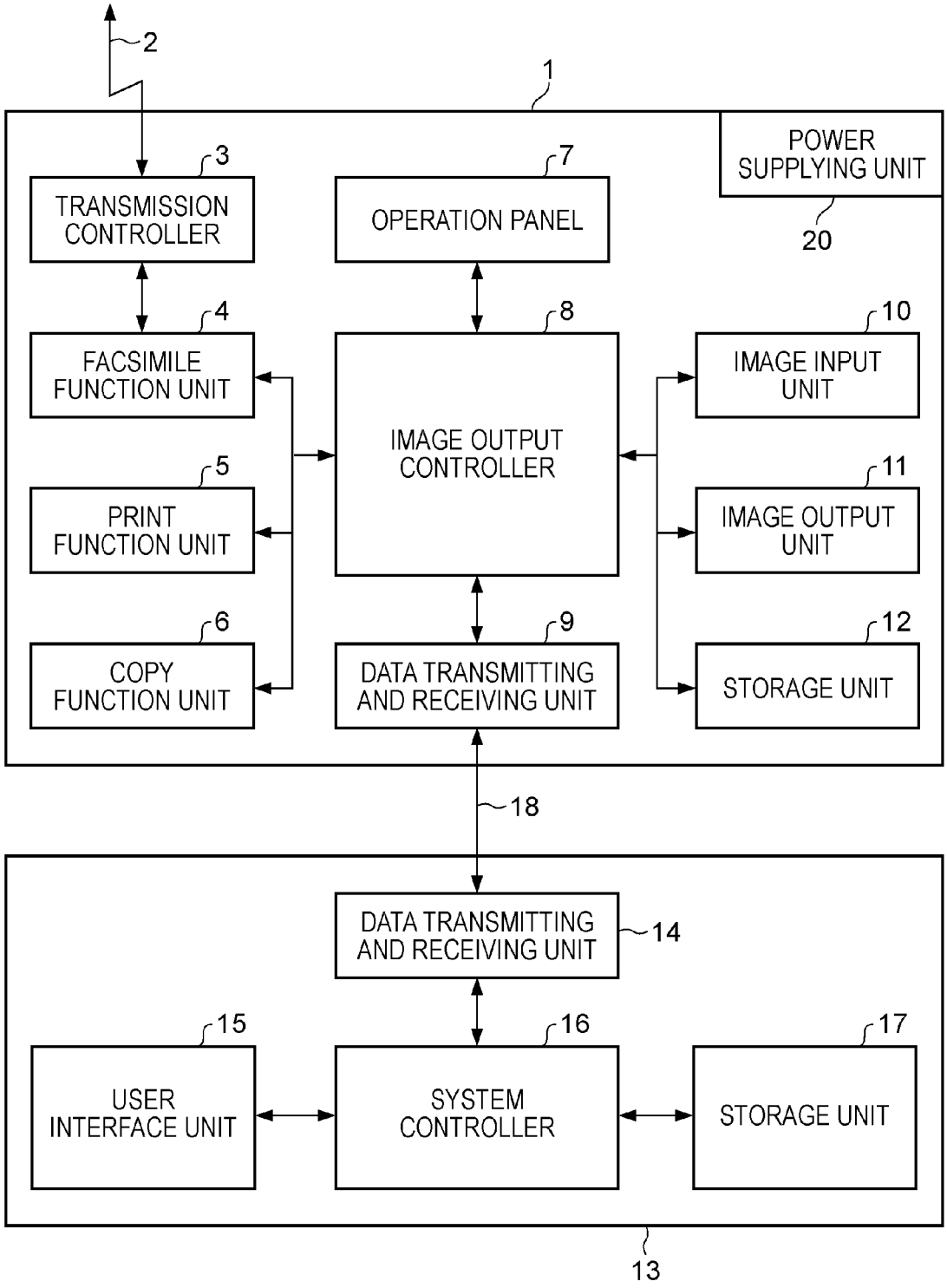
FIG. 1 is a block diagram showing an exemplary configuration of an image forming apparatus according to an aspect of the present invention.

FIG. 1 is a block diagram illustrating an exemplary configuration of a multifunction image forming apparatus to which the present invention may be applied. An image forming apparatus 1 has a facsimile function, a copy function, and a print function. The image forming apparatus 1 may communicate with a host computer 13 via a two-way communication interface 18.

In FIG. 1, a communication line 2 is a line for facsimile communication, and a transmission controller 3 performs transmission procedures and communication control, for transmission and reception of the facsimile. A facsimile function unit 4 compresses image data scanned by an image input unit 10 into facsimile transmission data, and expands facsimile data transmitted from the communication line 2.

A data transmitting and receiving unit 9 performs communication control for receiving print image data transmitted from the host computer 13, and transmits status information and identification information of the image forming apparatus 1 to the host computer 13. A print function unit 5 analyzes drawing data transmitted from the host computer 13, and develops the drawing data into bitmap data.

A copy function unit 6 converts the resolution of the data scanned by the image input unit 10, and processes the data. An operation panel 7 has buttons (keys), a LED indicator, a LCD indicator, a touch panel, and the like, arranged thereon for operation to select the function units (4, 5 and 6) and configures the settings for the function units. An image output unit 11 forms an image on a recording sheet on the basis of image data generated at each of the function units. The image output unit 11 includes various components for forming images according to the known electrophotographic method.

An image output controller 8 generally controls the image forming apparatus 1. The image output controller 8 allows each of the function units (4, 5 and 6) to perform its functional processing on the basis of information which is set by a user with the operation panel 7. In addition, the image output controller 8 transfers the image data generated by each of the function units to the image output unit 11 via a storage unit 12, and transfers the data scanned by the image input unit 10 to each of the function units via the storage unit 12.

Further, the image output controller 8 transfers the data generated by each of the function units to the host computer 13, in response to various commands sent from each of the function units, the operation panel 7, the image input unit 10, or the data transmitting and receiving unit 9. The above-described function units, the controllers, and the like, are generally controlled by a CPU (not shown). Also, a power supplying unit 20 supplies electric power entirely to the image forming apparatus 1.

The host computer 13 is a typical computer system. A data transmitting and receiving unit 14 is an interface for two-way communication, which is connected to the image forming apparatus 1 via the two-way communication interface 18. The data transmitting and receiving unit 14 transmits print data to the image forming apparatus 1, and receives data from the image forming apparatus 1.

A user interface unit 15 includes a data input device such as a keyboard, a pointing device, or the like, and a display device. A storage unit 17 includes a CPU, a RAM and ROM which store a boot program, various application programs, font data, user files, and the like, and a hard disk. The storage unit 17 stores not only the entire control program of the image forming apparatus 1, but also the identification information, and print or output data received from the image forming apparatus 1.

A system controller 16 generally controls the above-mentioned function units (14, 15 and 17) and the entire host computer 13 (various devices connected to a system bus, not shown).

Figure 2:
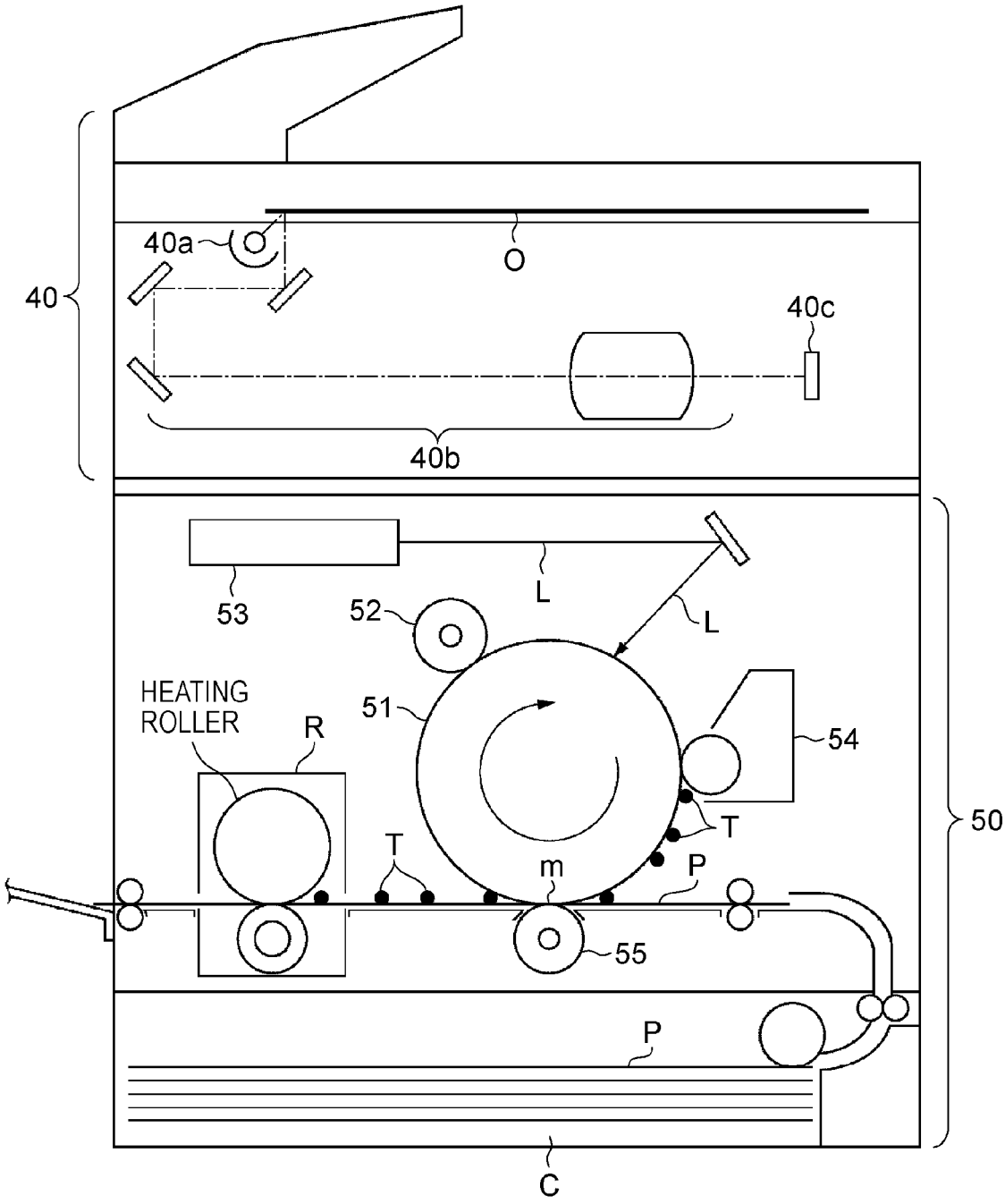
FIG. 2 is a general view schematically showing an exemplary image forming apparatus according to a first embodiment.

FIG. 2 is a general view schematically showing an exemplary image forming apparatus to which the present invention may be applied. The image forming apparatus according to the present embodiment employs a laser beam printer utilizing the electrophotographic process, the laser beam printer having a copy function, a facsimile transmission and reception function, and a print function.

An image scanning unit 40 corresponds to the image input unit 10 shown in FIG. 1. The image scanning unit 40 illuminates an original document O put on a document table by using a light source 40*a*, focuses reflected light reflected from the original document O on a CCD 40*c* through an optical system 40*b*, and scans original document image information as electric signals (image signals).

An image forming unit 50 corresponds to the image output unit 11 shown in FIG. 1. An electrophotographic photosensitive member (hereinafter, referred to as photosensitive drum) 51 is rotated clockwise as indicated by an arrow at a predetermined peripheral speed (process speed), and is evenly charged by a primary charging device 52 during the rotation. A laser beam scanner 53 emits laser beam L which is modulated on the basis of the image signals sent from the image scanning unit 40, and scans and irradiates the surface of the evenly charged photosensitive drum 51, to form an electrostatic latent image corresponding to the image information.

A developing unit 54 inversely develops the latent image (by which toner adheres on a bright potential portion exposed with the laser, located in the surface of the photosensitive drum), to be visualized as a toner image T. A transfer roller 55 is applied with a transfer bias which has a polarity opposite to that of the toner. A recording medium P fed from a paper feeding cassette C is fed to a pressure nip portion (transfer portion) m, defined between the transfer roller 55 and the photosensitive drum 51, in proper timing synchronously to the rotation of the photosensitive drum 51. Then, the toner image T on the surface of the photosensitive drum 51 is transferred onto the surface of the recording medium P by application of a transfer bias.

Then, the recording medium P on which the toner image T is transferred is parted from the surface of the rotating photosensitive drum 51, and is conveyed to a fixing device R. The fixing device R fixes the toner image T on the recording medium P. Then, the recording medium P is discharged as an image-formed product.

After the discharge of the recording medium P, if images are not formed for a predetermined time period or more, power supply to the fixing device R, and the controller and the like, of the image forming unit is stopped or the amount of electric power is reduced until an instruction for next image formation is given, so that the image forming apparatus 1 becomes a power save mode.

Figure 3:
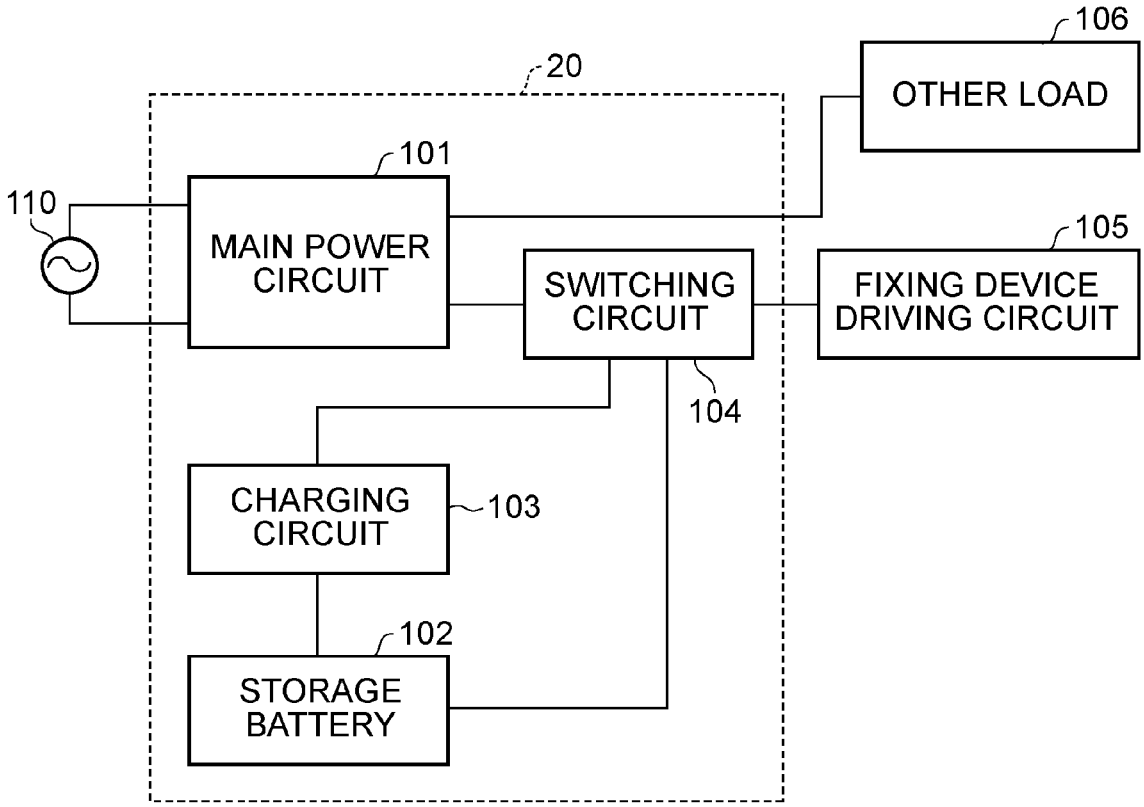
FIG. 3 is a block diagram showing an exemplary power supplying unit according to an aspect of the present invention.

FIG. 3 is a block diagram schematically showing an exemplary power supply system of the power supplying unit 20 shown in FIG. 1. A main power circuit 101 supplies electric power entirely to the image forming apparatus 1. A storage battery 102 functions as an auxiliary power source to supply electric power to a fixing device driving circuit together with the main power circuit 101, when the image forming apparatus 1 is activated, when it is restored from the power save mode, and the like, i.e., when the temperature of the fixing device does not reach a fixing temperature yet. A charging circuit 103 charges the storage battery 102. The storage battery 102 stores electric power according to an electrochemical method, such as using an electric double-layer capacitor.

A switching circuit 104 selects an option that combines electric power of the main power circuit 101 and that of the storage battery 102 and supplies the combined electric power to a fixing device driving circuit 105 (described later), or another option that supplies the electric power of the main power circuit 101 to the fixing device driving circuit 105 without application of the electric power of the storage battery 102. In addition, when the switching circuit 104 selects the way that supplies the electric power of the main power circuit 101 to the fixing device driving circuit 105 without the application of the electric power of the storage battery 102, the electric power of the main power circuit 101 is also supplied to the storage battery 102. The above-described components 101 trough 104 mainly form the power supplying unit 20.

The fixing device driving circuit 105 drives the fixing device when receiving the electric power applied from the switching circuit 104. A driving circuit 106 represents loads other than the fixing device and a driving circuit for the loads. The loads other than the fixing device may include charging devices, an exposure unit, a driving unit of the photosensitive drum, a conveying unit for the recording member, and the like. A commercial power supply 110 is also shown in the drawing.

The state where the switching circuit 104 supplies the electric power of the storage battery 102 to the fixing device driving circuit 105 is assumed as a discharge mode. In contrast, the state where the switching circuit 104 does not supply the electric power of the storage battery 102 to the fixing device driving circuit 105 and supplies the electric power of the main power circuit 101 to the charging circuit 103 is assumed as a charge mode. In the charge mode, the charging circuit 103 allows the storage battery 102 to be charged with the electric power of the main power circuit 101. In other words, the switching circuit 104 switches between the discharge mode and the charge mode for the storage battery 102. It should be noted that the charging of the storage battery 102 would not be performed at the same time as the discharging of the storage battery 102.

In the image forming apparatus 1, a mode setting is available for printing an image received at the facsimile function unit 4. In particular, the storage battery 102 may be operated in the charge mode in facsimile reception, and the storage battery 102 may be operated in the discharge mode in other situation (for example, when the copy function is executed). Alternatively, the storage battery 102 may be operated in the discharge mode constantly during image formation regardless of whether the image formation is on the basis of the image received by the facsimile or other situation. This setting is conducted based on manual setting with the operation panel 7.

Further, in the image forming apparatus 1, a time range (timer range) for operating the storage battery 102 constantly in the charge mode during the image formation, regardless of the setting of the facsimile reception. A timer is set with the operation panel 7. It is noted that these two settings are conducted in a standby state where the image is not formed.

Figure 4:
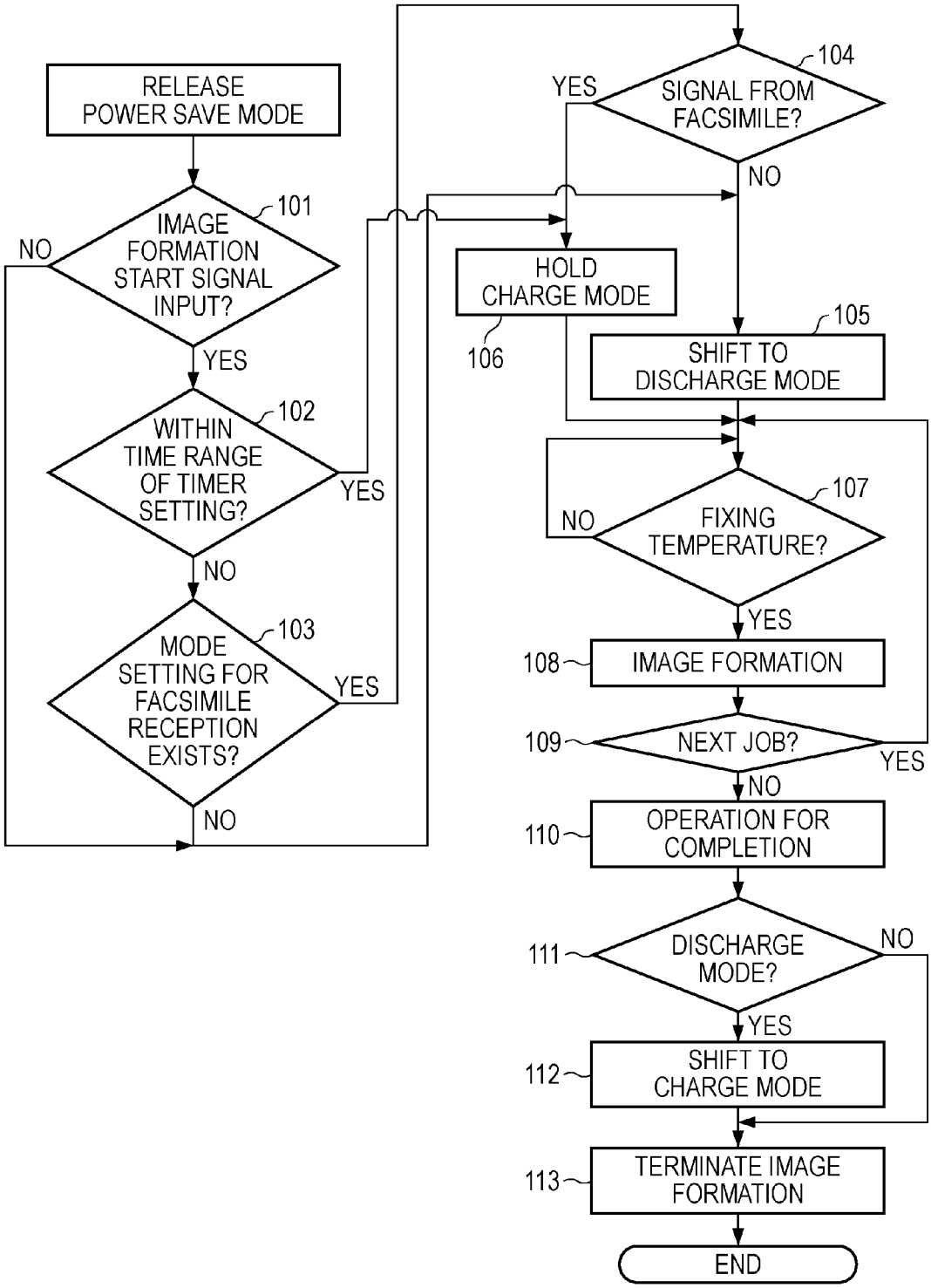
FIG. 4 is an exemplary control flowchart according to the first embodiment.

FIG. 4 is a flowchart showing the control of the image output controller 8 when the power save mode is released according to the present embodiment. Note that, in the power save mode, the storage battery 102 is operated in the charge mode.

Initially, the controller 8 determines whether the power save mode of the image forming apparatus 1 has been inhibited (or deactivated) because an image formation start instruction (image formation start signal) has input, or because of other situation (step 101). If the power save mode has been inhibited (or deactivated) because the image formation start signal has been input (YES in step 101), the controller 8 determines whether or not the current time is within a time range of the timer preset with the operation panel 7 (step 102), and if the current time is within the preset time range (YES in step 102), the controller 8 waits for that the temperature of the fixing device becomes the fixing temperature while the storage battery 102 is held in the charge mode (steps 106 and 107).

If the timer is not preset, or the current time is not within the preset time range (NO in step S102), the controller 8 determines whether or not the storage battery 102 is set as it is in the charge mode during the facsimile image formation (step 103). If it is determined that the above-mentioned presetting does not exist (NO in step 103), the controller 8 shifts the storage battery 102 to the discharge mode, and waits for that the temperature of the fixing device becomes the fixing temperature (steps 105 and 107).

If the reason for inhibiting (or deactivating) the power save mode is not the inputting of the image formation start signal (NO in step 101), the controller 8 shifts the storage battery 102 to the discharge mode (step 105). Here, for example, the reason other than the inputting of the image formation start signal may be restart of the image forming apparatus 1, key operation for releasing the power save mode, key operation for copying, or the like.

If determining that the mode where the image forming apparatus 1 is operated in the charge mode in the facsimile reception (NO in step 103), the controller 8 determines whether the image to be formed is received according to the facsimile function or not (step 104). If the image to be formed is received according to the facsimile function (YES in step 104), the controller 8 holds the storage battery 102 in the charge mode (step 106), and if the image to be formed is received according to other function (i.e., according to the print function), the controller 8 shifts the storage battery 102 to the discharge mode (step 105).

Next, the controller 8 determines whether the temperature of the fixing device reaches the fixing temperature or not (step 107). If the temperature of the fixing device reaches the fixing temperature (YES in step 107), the controller 8 starts the image forming operation (step 108). Then, the controller 8 determines whether the next image formation job is present or not (step 109). If the next image formation job is not present (NO in step 109), the controller 8 performs operations for completing the image formation, for example, reverse rotation of the image forming unit (step 110).

During the operation for the completion, the controller 8 determines whether the storage battery 102 is in the discharge mode or the charge mode (step 111). If the storage battery 102 is in the charge mode (No in step 111), the controller 8 terminates image formation (step 113) and the process ends. If the controller 8 holds the current state of the storage battery 102, and if the storage battery 102 is in the discharge mode (YES in step 111), the controller 8 shifts the storage battery 102 to the charge mode (step 112) and terminates the operation for completing the image formation (step 113).

Also, if the image formation is not started within a predetermined time period after the completion of the image formation, the state of the image forming apparatus 1 becomes the power save mode again.

According to the first embodiment, in the case of forming the image of the document received by the facsimile, the electric power is supplied to the fixing device from the main power circuit during the image formation without the application of the electric power of the storage battery 102, even though a time necessary for the image formation (including a time for starting the image formation) becomes relatively long. Accordingly, the number of times for switching between charging and discharging of the storage battery 102 can be decreased, so that the life of the storage battery 102 can be extended.

Second Exemplary Embodiment

In a second embodiment, there is described an operation in a case where the illuminance of the installation place of the image forming apparatus 1 is a predetermined value or less.

Figure 5:
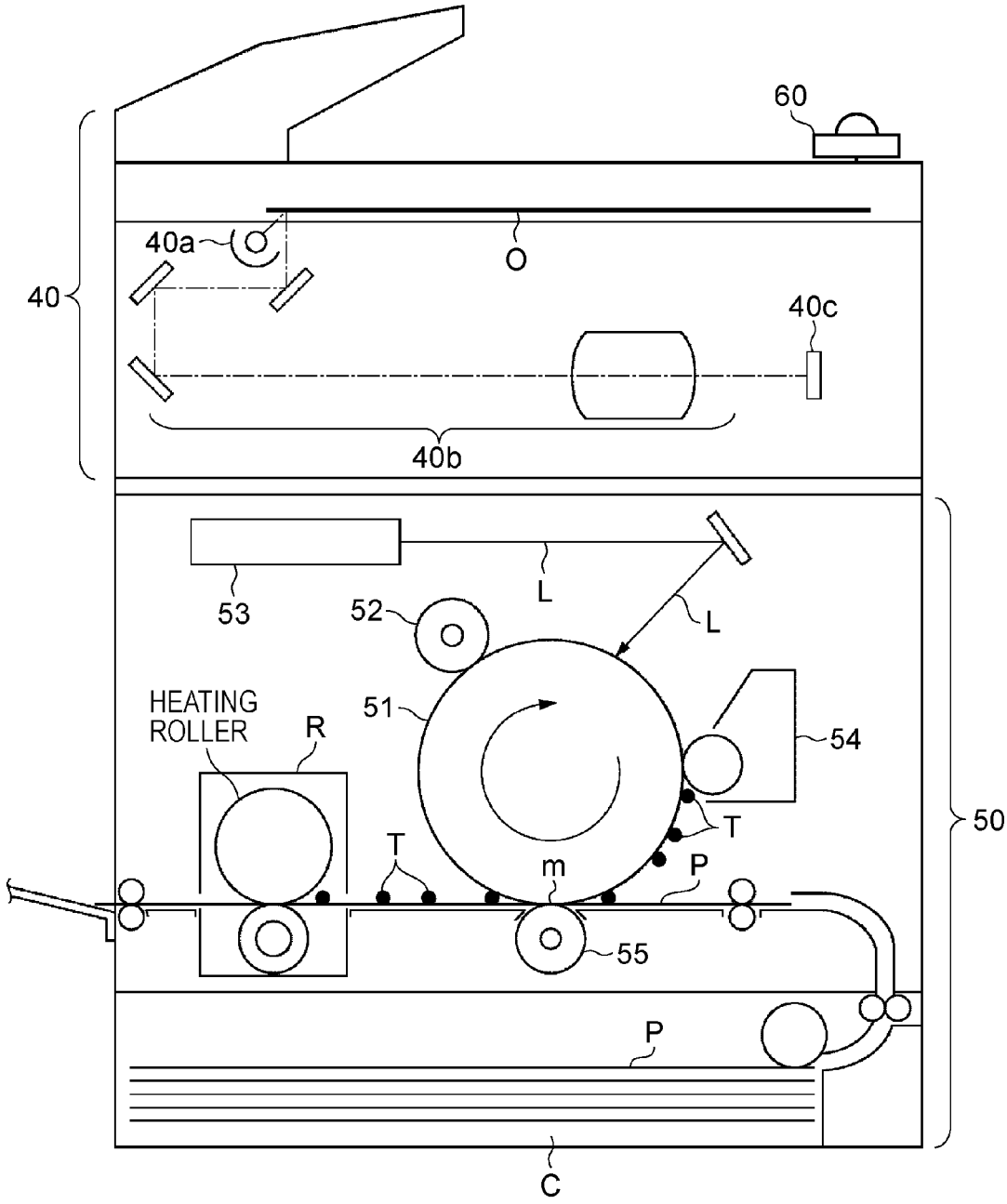
FIG. 5 is a general view schematically showing an image forming apparatus according to a second embodiment.

FIG. 5 is a general view schematically showing an exemplary image forming apparatus according to the second embodiment. The configuration of the image forming apparatus 1 according to the second embodiment includes an illuminance sensor 60 that measures the illuminance of the installation place of the image forming apparatus 1 (in this embodiment, the illuminance at an upper surface of the image forming apparatus 1), in addition to the configuration thereof according to the first embodiment shown in FIG. 2. A light receiving portion of the illuminance sensor 60 is formed according to the silicon photo diode method, the measurable range of the illuminance is from 0 to 1999 lux, and the resolution thereof is 1 lux. The output signal of the illuminance sensor 60 is considered to be sent to the image output controller 8 shown in FIG. 1.

With the image forming apparatus in the second embodiment, an operation mode of the storage battery 102 can be set in accordance with the illuminance detected by the illuminance sensor 60. In particular, if the detected illuminance is the predetermined value or less, the storage battery 102 may be operated in the charge mode, and if the detected illuminance is more than the predetermined value, the storage battery 102 may be operated in the discharge mode. Alternatively, the storage battery 102 may be operated in the discharge mode during the image formation regardless of the detected illuminance. This selection is conducted based on manual setting with the operation panel 7.

In addition, with the image forming apparatus in the second embodiment, time setting is available and it includes a timer setting A and a timer setting B. The timer setting A is a time range for operating the storage battery 102 in the charge mode during the image formation regardless of whether the image is received by the facsimile or by other function.

The timer setting B is a time range for making effective the function of operating the storage battery 102 in the charge mode, if the illuminance detected by the illuminance sensor 60 is the predetermined value or less. The timer settings A and B are performed with the operation panel 7.

Figure 6:
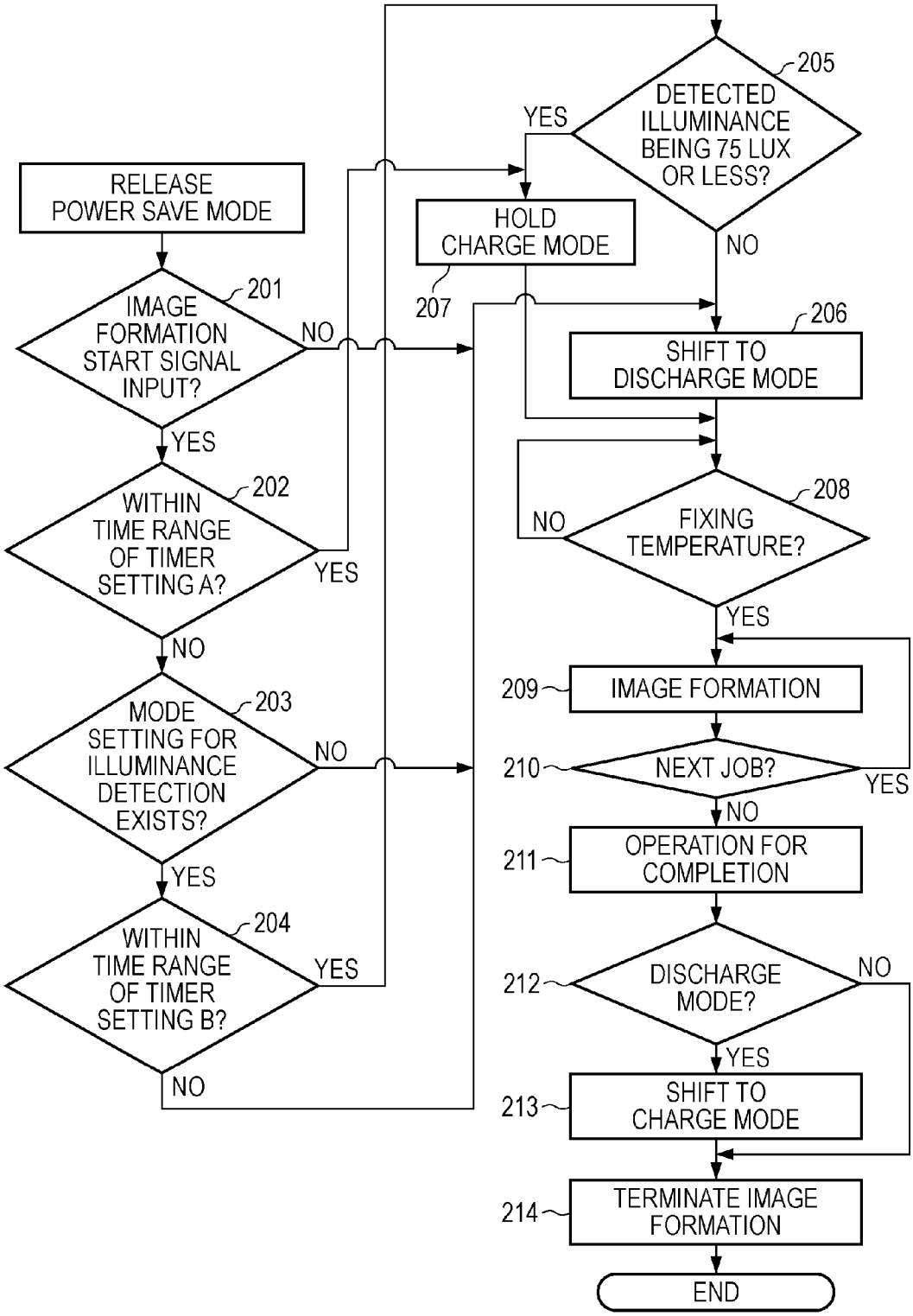
FIG. 6 is an exemplary control flowchart according to the second embodiment.

FIG. 6 is a flowchart showing exemplary control of the image output controller 8 when the power save mode is released according to the present embodiment. Note that, in the power save mode, the storage battery 102 is operated in the charge mode.

First, the controller 8 determines whether the power save mode of the image forming apparatus 1 has been inhibited (or deactivated) because the image formation start instruction (image formation start signal) has input, or because of another situation (step 201).

If the power save mode has been inhibited (or deactivated) because the image formation start signal has been input (YES in step S201), the controller 8 determines whether the current time is within the time range defined by the timer setting A or not (step 202). And if the current time is within the preset time range (YES in step 202), the storage battery is held in the charge mode (step 207). Then, the controller 8 waits until the temperature of the fixing device becomes the fixing temperature while the storage battery 102 is held in the charge mode (steps 208).

If the timer setting A is not preset, or the current time is not within the preset time range, the controller 8 determines whether or not the storage battery 102 is set as the mode of the storage battery 102 is selected according to the value of the detected illuminance (step 203). If determining that the above-mentioned presetting does not exist in the step 203 (NO in step 203), the controller 8 operates the storage battery 102 in the discharge mode and waits for that the temperature of the fixing device becomes the fixing temperature (steps 206 and 208).

If the controller 8 determines that the setting exists in the step 203 (YES in step 203), the controller 8 determines whether the current time is within the timer setting B or not (step 204). If the current time is within the setting time (YES in step 204), the controller 8 determines whether or not the illuminance detected by the illuminance sensor 60 is the predetermined value (in this embodiment, 75 lux) or less (step 205).

If the detected illuminance is the predetermined value or less (YES in step 205), the controller 8 waits for the temperature of the fixing device to become the fixing temperature while holding the storage battery 102 in the charge mode (steps 207 and 208). If the detected illuminance is more than the predetermined value (YES in step 205), the controller 8 operates the storage battery 102 in the discharge mode and waits for the temperature of the fixing device to become the fixing temperature (steps 206 and 208).

Also, in the step 204, if the current time is not within the time range according to the timer setting B, the controller 8 operates the storage battery 102 in the discharge mode and waits for that the temperature of the fixing device becomes the fixing temperature (steps 206 and 208).

And also, in step 201, if the reason for inhibiting (or deactivating) the power save mode is not the inputting of the image formation start signal (NO in step 201), the controller 8 shifts the storage battery 102 to the discharge mode (step 206). Reasons other than the inputting of the image formation start signal may be restart of the image forming apparatus 1, key operation for releasing the power save mode, key operation for copying, or the like.

Still referring to FIG. 6, the controller 8 then determines whether the temperature of the fixing device reaches the fixing temperature or not (step 208), and if the temperature of the fixing device reaches the fixing temperature (YES in step 208), the controller 8 starts the image forming operation (step 209). The controller 8 then determines whether the next image formation job is present or not (step 210).

If the next image formation job is not present (NO in step 210), the controller 8 performs an operation for completing the image formation, for example, reverse rotation of the image forming unit (step 211). During the operation for the completion, the controller 8 determines whether the storage battery 102 is in the discharge mode or the charge mode (step 212). If the storage battery 102 is in the charge mode (NO in step 212), the controller 8 holds the charge mode of the storage battery 102 and terminates the operation for completing the image formation (step 214) and the process ends. If the storage battery 102 is in the discharge mode (YES in step 212), the controller 8 shifts the storage battery 102 to the charge mode and terminates the operation for completing the image formation (step 214) and the process ends.

According to the second embodiment, if it is determined that the illuminance around the image forming apparatus is dark, it may be considered that there is no person around the apparatus. Therefore, the electric power is supplied to the fixing device from the main power circuit during the image formation without the application of the electric power of the storage battery 102, even though a time necessary for the image formation becomes relatively long. As a result, the number of times for switching between charging and discharging of the storage battery 102 can be decreased, so that the life of the storage battery 102 can be extended.

Third Exemplary Embodiment

In a third embodiment, there is described an operation in a case where there is no person present around the image forming apparatus.

Figure 7:
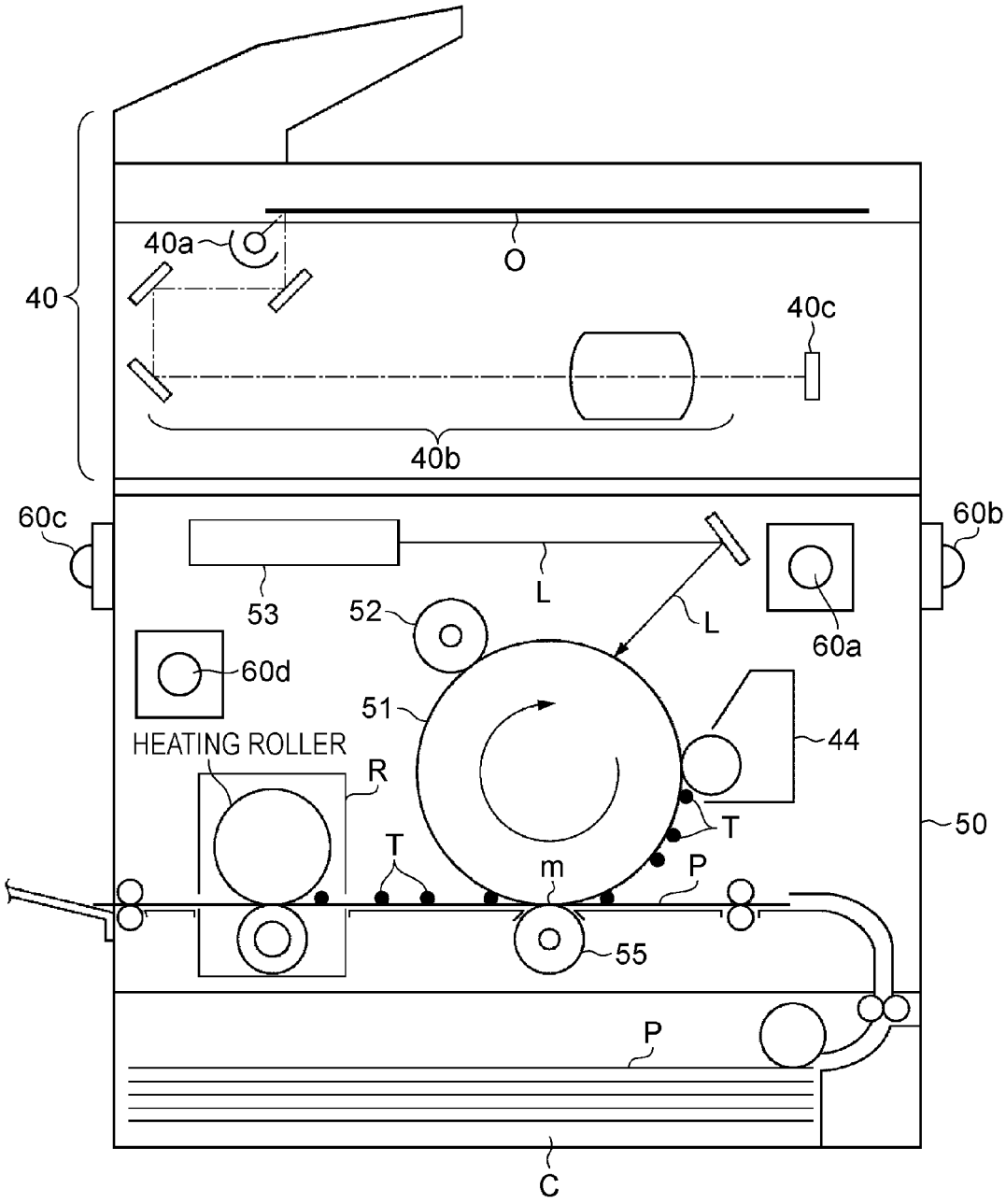
FIG. 7 is a general view schematically showing an exemplary image forming apparatus according to a third embodiment.

FIG. 7 is a general view schematically showing an image forming apparatus according to the third embodiment. The configuration of the image forming apparatus 1 according to the third embodiment includes sensors 60*a*, 60*b*, 60*c* and 60*d* provided at the front surface and both lateral surfaces of the image forming apparatus, for detecting a human body present around the image forming apparatus, in addition to the configuration thereof according to the first embodiment shown in FIG. 2. These sensors are human detecting sensors that employ a Fresnel lens having the angle of view being about 80° and the field length being 2 mm, and a pyroelectric infrared sensor. If at least one of the sensors detects a human body, the controller 8 determines that there is a person present around the image forming apparatus. The output signals of the sensors 60*a*, 60*b*, 60*c* and 60*d* are considered to be sent to the image output controller 8 shown in FIG. 1.

In the image forming apparatus according to the third embodiment, setting may be a way that selects the charge mode or the discharge mode on the basis of the detection result of the human detecting sensors 60*a*, 60*b*, 60*c* and 60*d*, or a way that constantly operates the storage battery in the discharge mode during the image formation. This selection is conducted based on manual setting with the operation panel 7.

In addition, with the image forming apparatus in the third embodiment, timer setting is available and it includes a timer setting A and a timer setting B. The timer setting A is a time range for operating the storage battery 102 in the charge mode during the image formation regardless of the detection result of the human detecting sensors 60*a*, 60*b*, 60*c* and 60*d*.

The timer setting B is a time range for making effective the function of operating the storage battery 102 in the charge mode, if the detection results of the human detecting sensors 60*a*, 60*b*, 60*c* and 60*d* indicate that there is no human body. The timer settings A and B are performed with the operation panel 7.

Figure 8:
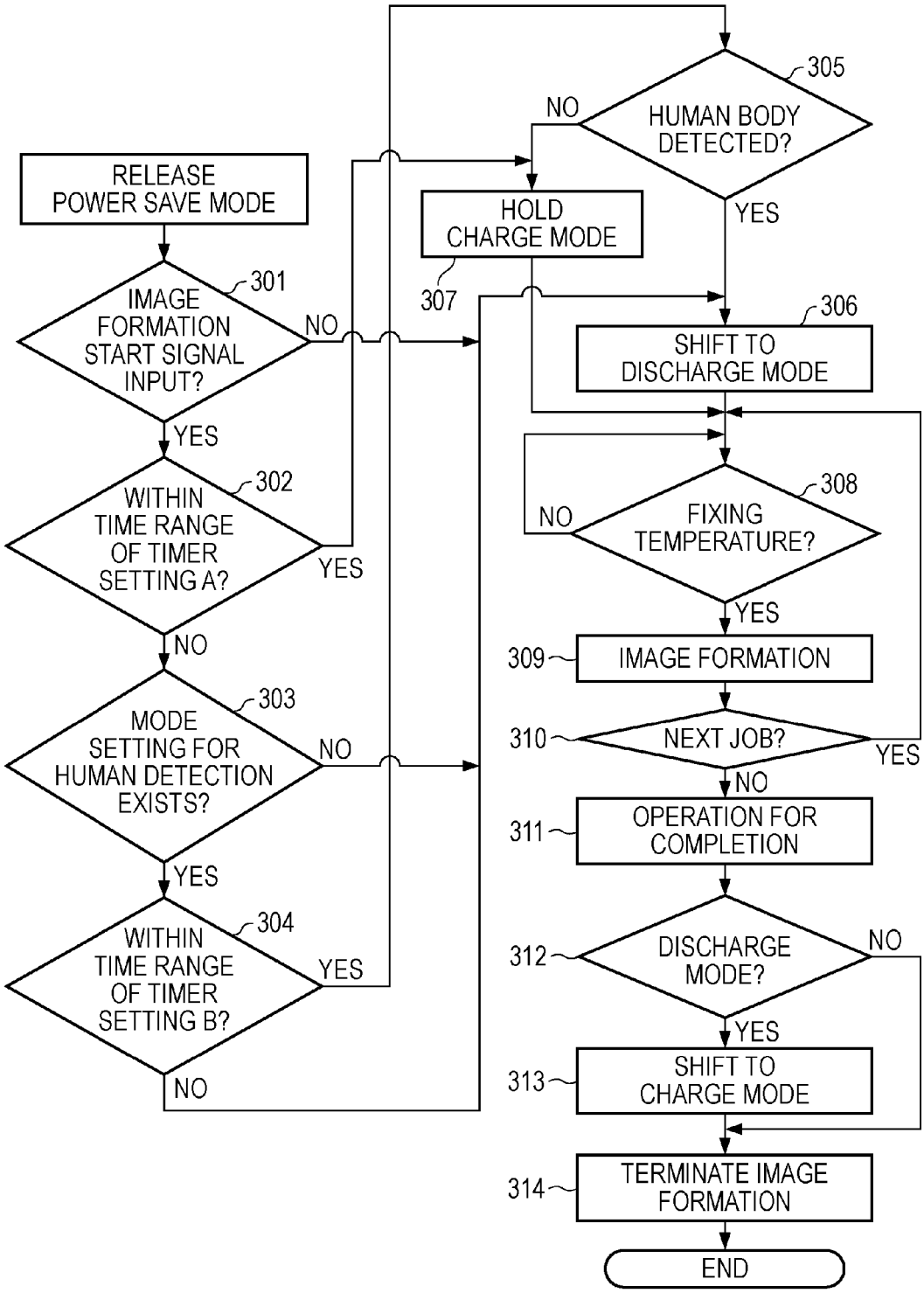
FIG. 8 is an exemplary control flowchart according to the third embodiment.

FIG. 8 is a flowchart showing exemplary control of the image output controller 8 when the power save mode is released according to the present embodiment. Note that, in the power save mode, the storage battery 102 is operated in the charge mode.

First, the image output controller 8 determines whether the power save mode of the image forming apparatus 1 has released because the image formation start instruction (image formation start signal) has input, or because of another situation (step 301).

If the power save mode has released because the image formation start signal has input (YES in step 301), the controller 8 determines whether the current time is within the time range defined by the timer setting A or not (step 302). Then, if the current time is within the preset time range, the controller 8 waits for that the temperature of the fixing device to become the fixing temperature while the storage battery 102 is held in the charge mode (steps 307 and 308).

If the timer setting A is not preset, or the current time is not within the preset time range (NO in step 302), the controller 8 determines whether or not the mode setting for human detection exists (step 303). If it is determined that the human presetting does not exist (NO in step 303), the controller 8 operates the storage battery 102 in the discharge mode and waits for that the temperature of the fixing device to become the fixing temperature (steps 306 and 308).

If the controller 8 determines that the setting exists in the step 303 (YES in step 304), the controller 8 determines whether the current time is within the timer setting B or not (step 304), and if the current time is within the setting time (YES in step 305), the controller 8 determines whether any one of the human detecting sensors 60*a* through 60*d* detects a human body or not (step 305).

If a human body is not detected (NO in step 305), the controller 8 waits for that the temperature of the fixing device to become the fixing temperature while holding the storage battery 102 is in the charge mode (steps 307 and 308). If a human body is detected (YES in step 305), the controller 8 operates the storage battery 102 in the discharge mode and waits for that the temperature of the fixing device to become the fixing temperature (steps 306 and 308).

In the step 304, if the current time is not within the time range according to the timer setting B (NO in step 304), the controller 8 operates the storage battery 102 in the discharge mode and waits for that the temperature of the fixing device becomes the fixing temperature (steps 306 and 308).

Still referring to FIG. 8, in the step 301, if the reason of inhibiting (or deactivating) the power save mode is not the inputting of the image formation start signal (NO in step 301), the controller 8 shifts the storage battery 102 to the discharge mode (step 306). Reasons other than the inputting of the image formation start signal may be restart of the image forming apparatus 1, key operation for releasing the power save mode, key operation for copying, or the like.

Next, the controller 8 determines whether the temperature of the fixing device reaches the fixing temperature or not (step 308), and if the temperature of the fixing device reaches the fixing temperature (YES in step 308), the controller 8 starts the image forming operation (step 309). Then, the controller 8 determines whether the next image formation job is present or not (step 310).

If the next image formation job is not present (NO in step 310), the controller 8 performs operations for completing the image formation, for example, reverse rotation of the image forming unit (step 311), and during the operation for the completion, the controller 8 determines whether the storage battery 102 is in the discharge mode or the charge mode (step 312). If the storage battery 102 is in the charge mode (NO in step 312), the controller 8 holds the charge mode of the storage battery 102, terminates image formation (step 314) and then the process ends. Otherwise, if the storage battery 102 is in the discharge mode (YES in step 312), the controller 8 shifts the storage battery 102 to the charge mode and terminates the operation for completing the image formation (steps 313 and 314).

According to the third embodiment, if a person is not present around the apparatus, the electric power is supplied to the fixing device from the main power circuit during the image formation without the application of the electric power of the storage battery 102, even though the time necessary for the image formation becomes relatively long. As a result, the number of times for switching between charging and discharging of the storage battery 102 can be decreased, so that the life of the storage battery 102 can be extended.

In the above-described first to third embodiments, the control when being restored from the power save mode is described. However, the control in the embodiments may be applied to a case where the temperature of the fixing device does not reach the fixing temperature and thus the fixing device is necessary to be heated when the image formation start instruction (copy instruction, facsimile reception, or print instruction) is input. For example, the image forming apparatus may wait for the inputting of the image formation start instruction, and if the input is recognized, procedures including the step 102 and subsequent steps shown in FIG. 4, the step 201 and subsequent steps shown in FIG. 6, or the step 302 and subsequent steps shown in FIG. 8 may be executed.

Alternatively, in other embodiments, the control according to the first through third embodiments may be combined and operated.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-366453 filed Dec. 20, 2005, which is hereby incorporated by reference herein in its entirety.

What is claimed is:

1. An image forming apparatus having a first function for forming an image received by facsimile, and a second function for forming an image other than the image received by the facsimile, the apparatus comprising:

an image forming unit configured to form a toner image on a sheet;

a fixing device configured to fix the toner image to the sheet;

a main power circuit configured to supply electric power for operating the image forming apparatus;

an auxiliary power circuit configured to store the electric power and supply the stored electric power for operating the image forming apparatus;

a switching device configured to switch between a charge mode for charging the auxiliary power circuit and a discharge mode for discharging the stored electric power in the auxiliary power circuit; and a control device configured to, when the image is formed on the basis of the first function, control the switching device so as to operate the auxiliary power circuit not in the discharge mode so that the electric power of the main power circuit is supplied to the fixing device, and when the image is formed on the basis of the second function, control the switching device so as to operate the auxiliary power circuit in the discharge mode so that the electric power of the main power circuit and that of the auxiliary power circuit are supplied to the fixing device.

2. An image forming apparatus having a first function for forming an image received by facsimile, and a second function for forming an image other than the image received by the facsimile, the apparatus comprising:

a main power circuit configured to supply electric power for operating the image forming apparatus;

an auxiliary power circuit configured to store the electric power and supply the stored electric power for operating the image forming apparatus;

a switching device configured to switch between a charge mode for charging the auxiliary power circuit and a discharge mode for discharging the stored electric power in the auxiliary power circuit; and a control device configured to, when the image is formed on the basis of the first function, operate the auxiliary power circuit in the charge mode to operate the image forming apparatus with the electric power of the main power circuit, and when the image is formed on the basis of the second function, operate the auxiliary power circuit in the discharge mode to operate the image forming apparatus with the electric power of the main power circuit and that of the auxiliary power circuit.

3. The image forming apparatus according to claim 2, further comprising a time range setting device configured to set a time range for operating the auxiliary power circuit in the charge mode when an image formation start instruction is input, regardless of whether the image is formed on the basis of the first function or the second function.

4. The image forming apparatus according to claim 2, further comprising a function setting device configured to set whether a function for operating the auxiliary power circuit in the charge mode is made effective or not, when the image is formed on the basis of the first function.

5. An image forming apparatus having a first function for forming an image received by facsimile, and a second function for forming an image other than the image received by the facsimile, the apparatus comprising:

a main power circuit configured to supply electric power for operating the image forming apparatus;

an auxiliary power circuit configured to store the electric power and supply the stored electric power for operating the image forming apparatus;

a switching device configured to switch between a charge mode for charging the auxiliary power circuit and a discharge mode for discharging the stored electric power in the auxiliary power circuit; and a control device configured to shift the image forming apparatus to a power save mode if the image forming apparatus does not form the image for a predetermined time period, wherein, when the power save mode is deactivated for forming the image on the basis of the first function, the control device operates the auxiliary power circuit in the charge mode to operate the image forming apparatus with the electric power of the main power circuit, and when the power save mode is deactivated for forming the image on the basis of the second function, the control device operates the auxiliary power circuit in the discharge mode to operate the image forming apparatus with the electric power of the main power circuit and that of the auxiliary power circuit.

* * * * *